US009019062B2

(12) United States Patent
Hejny

(10) Patent No.: US 9,019,062 B2
(45) Date of Patent: Apr. 28, 2015

(54) INDUCTIVE DEVICE WITH IMPROVED CORE PROPERTIES

(75) Inventor: Kvetoslav Hejny, Sumvald (CZ)

(73) Assignee: EPCOS AG, Munich (DE)

( * ) Notice: Subject to any disclaimer, the term of this patent is extended or adjusted under 35 U.S.C. 154(b) by 132 days.

(21) Appl. No.: 13/309,764

(22) Filed: Dec. 2, 2011

(65) Prior Publication Data

US 2012/0200382 A1 Aug. 9, 2012

(30) Foreign Application Priority Data

Dec. 8, 2010 (DE) ..... 10 2010 053 810
Nov. 30, 2011 (DE) ..... 10 2011 055 880

(51) Int. Cl.

| | |
|---|---|
| ***H01F 27/24*** | (2006.01) |
| ***H01F 21/08*** | (2006.01) |
| ***H01F 17/06*** | (2006.01) |
| ***H01F 3/10*** | (2006.01) |

(52) U.S. Cl.
CPC ..... *H01F 3/10* (2013.01); *H01F 2003/106* (2013.01)

(58) Field of Classification Search
USPC ..... 336/178, 212, 165, 219
See application file for complete search history.

(56) References Cited

U.S. PATENT DOCUMENTS

| | | | | |
|---|---|---|---|---|
| 3,602,859 | A * | 8/1971 | Dao | 336/83 |
| 4,334,206 | A * | 6/1982 | Nakamura | 336/96 |
| 4,943,793 | A | 7/1990 | Ngo et al. | |
| 5,062,197 | A * | 11/1991 | Ngo et al. | 29/606 |
| 5,315,279 | A * | 5/1994 | Ito et al. | 336/178 |
| 5,731,666 | A * | 3/1998 | Folker et al. | 315/276 |
| 6,980,077 | B1 * | 12/2005 | Chandrasekaran et al. | 336/212 |
| 7,449,984 | B2 * | 11/2008 | Kawarai | 336/83 |
| 2002/0190830 | A1 | 12/2002 | Matsumoto et al. | |
| 2006/0125586 | A1 | 6/2006 | Lee et al. | |
| 2007/0040643 | A1 | 2/2007 | Inoue et al. | |
| 2008/0055034 | A1 | 3/2008 | Tsunemi et al. | |
| 2009/0079532 | A1 | 3/2009 | Muelleman | |
| 2010/0102917 | A1 * | 4/2010 | Liu et al. | 336/221 |
| 2011/0121935 | A1 | 5/2011 | Chu et al. | |

FOREIGN PATENT DOCUMENTS

| | | | |
|---|---|---|---|
| DE | 39 13 558 | A1 | 11/1990 |
| DE | 696 13 794 | T2 | 11/2001 |
| DE | 102 12 930 | A1 | 11/2002 |
| DE | 10 2006 026 466 | B3 | 12/2007 |
| DE | 10 2008 034 691 | A1 | 3/2010 |
| EP | 1 061 140 | A1 | 12/2000 |
| EP | 1 211 700 | A2 | 6/2002 |
| JP | 05190346 | A * | 7/1993 |

* cited by examiner

*Primary Examiner* — Tsz Chan
(74) *Attorney, Agent, or Firm* — Slater & Matsil, L.L.P.

(57) ABSTRACT

An inductive component has a winding and a core that includes a plurality of core areas that contain different magnetic materials.

15 Claims, 2 Drawing Sheets

INDUCTIVE DEVICE WITH IMPROVED CORE PROPERTIES

This application claims priority to German Patent Application 10 2010 053 810.8, which was filed Dec. 8, 2010 and German Patent Application 10 2011 055 880.2, which was filed Nov. 30, 2011, both of which are incorporated herein by reference.

TECHNICAL FIELD

The present invention relates to an inductive component having a winding and a core.

BACKGROUND

Inductive components such as inductors, transformers and reactors are widely used in electrical and electronic circuits. The electrical characteristics of the inductive components depend on their construction and the characteristics of the windings and of the core. The desired inductive characteristics may be achieved, for example, by suitable choice and/or adaptation of the winding and/or of the permeability. The permeability can be reduced by a large air gap, although this increases the stray flux in the air gap, and therefore the losses involved. In particular, the aim is to improve the characteristics of the magnetic core.

SUMMARY

The invention provides an inductive component having a winding and a core which comprises a plurality of core areas which contain a plurality of different magnetic materials. The term winding in the context of the inductive component means a single-layer and multi-layer winding, as well as one of a plurality of such windings on a core.

The different magnetic materials preferably have different magnetic characteristics. The term different magnetic materials should be understood as meaning that it includes at least two different magnetic materials or that it includes a material with a physical/chemical composition with magnetic material parameters which differ in places. By way of example, the parameters may be optimized for the operating conditions of the areas.

In principle, a magnetic core such as this may comprise any core shape, that is to say for example core shapes with the designations C, U, E, P, X, annular core or further core shapes, or core shapes derived therefrom. However, the invention can be used particularly advantageously for core shapes which have a center column or a center leg. In this context, the limbs and the yoke areas which connect them to the center leg can be understood to be other core areas. Typically, the complete core is formed from two core halves which each comprise limbs, yokes and a center leg. Alternatively, the core may comprise a center leg and separate outer core parts. Other shapes are feasible for separation.

In the core of the inductive component, the center leg itself contains different materials, or the center leg contains a different magnetic material than the other areas of the core, or the core is formed from a combination of the two alternatives.

In this case, the different materials may in one preferred embodiment be in the form of layers, whose layers are arranged one behind the other in an alternating sequence, for example, in the axial direction of the center column. These layers may be in the form of disks and may alternately contain a layer with high permeability and a layer with zero or low permeability. Another preferred embodiment contains a center leg composed of a magnetic material which is different from the magnetic material of the other core areas. A further preferred embodiment contains combinations of the two above-mentioned embodiments. In this case, the center leg is mechanically connected to the other core areas either by adhesive bonding or by screwing. In the case of a screw connection, the center leg preferably has a central hole through which a plastic screw is passed, which holds the core together. Alternatively, the parts can also be connected by latching or bracing. This is particularly expedient in the case of two core halves placed opposite to one another, because the single plastic screw then holds the two core halves together at the same time.

Particularly, in the case of transformers and inductors, an air gap is an important functional component, because it considerably reduces the magnetic flux density in the core and, for example, linearizes the magnetization characteristic, such that magnetic saturation of the core material occurs only at higher field strengths. A major proportion of the magnetic energy is stored in the air gap of storage inductors, and this leads to disadvantages such as lower inductance or excessively high forces. In the case of cores having center legs, the air gap is typically arranged between the two center legs in the core halves. The proposed inductive component makes it possible to distribute the air gap effectively over the length of the entire center leg. The air gap which is distributed over a plurality of sections can be formed in the center leg by disks, for example, composed of ferrite material, separated by disks composed of a different material.

The inductive component makes it possible to improve disadvantageous characteristics of the magnetic core. These include, in particular, a reduction in the stray flux and in the losses. This makes it possible to prevent higher temperatures which result from the losses, and to reduce the costs for a cooling system. At the same time, it is possible to improve the efficiency of the inductive component.

The design and the production of a core for an inductive component will be explained purely by way of example based on the design of a magnetic core with center legs. In particular, iron powder material or ferrite material, that is to say ferromagnetic materials advantageously with high saturation levels, may be used as different magnetic materials for the core. Both materials have disadvantages and advantages which are known in their own right. For example, an iron powder core has the disadvantage that it is brittle, but the advantage of the high saturation level Bs of 1 Tesla (1 T) to 1.5 T, which can be achieved, for example, by means of an iron powder core. The individual powder grains, which are also separated from one another by a non-magnetic or slightly magnetic layer, in their own right result in a distribution of the air gap which causes an improvement in the saturation induction and a soft saturation onset. In contrast, a standard ferrite material has a saturation level Bs of about 0.4 T, and a steep saturation behavior.

The use of a plurality of different magnetic materials for example, in the center leg of a magnetic core makes it possible to optimize the magnetic characteristics of the core. For example, depending on the design of the core, the resultant saturation level will be in the range between the saturation level of a ferrite material and that of a powder material, for example, iron powder material. This means that the saturation level will be in the range between 0.4 T and 1.5 T.

The combination of a material with relatively low permeability for the center leg, such as iron powder with a permeability of 10 to 50 by way of example, and of a ferrite material for the other areas, for example, with a permeability of 1000 to 3000, makes it possible to reduce the overall permeability and the overall length of the air gap or of the air gaps, in comparison to a core composed only of ferrite material. The overall permeability is:

$$\mu_{tot} = \frac{l_{e,tot}}{\left(\frac{l_1}{\mu_1} + \frac{l_2}{\mu_2} + \frac{l_i}{\mu_i} + \ldots\right)},$$

where $\mu_{tot}$ is the overall permeability, $l_{e,tot}$ is the overall effective length of the magnetic circuit, is the magnetic length of an i-th area and $\mu_i$ is the permeability of the i-th area.

Because the overall length of the air gaps in the center leg is shorter, the lengths of the partial air gaps are also shorter, thus reducing the stray flux and the losses resulting from it.

The optimization of the magnetic core characteristics in turn makes it possible to reduce the dimensions of the core, and in particular to reduce the cross section or the diameter of the center leg and of the winding fitted to it, which in turn makes it possible to reduce the volume of the winding. This in turn makes it possible to reduce the overall dimensions of an inductive component, and thus likewise to reduce the costs for production of the inductive component. The reduction in the effective area of the center leg when using a material with a higher saturation level results in an increase in the saturation level and is, for example, 0.4 T/1.5 T when using a material with 1.5 T, in comparison to the use of a material with 0.4 T. The reduction in the center leg diameter also results in a reduction in the external dimensions of the component, which makes it possible to use smaller housings, which save material and therefore cost less.

The effective length of the winding results from the number of the turns and the length of the respective winding. The overall length of the wire in the winding is therefore reduced if the internal diameter of the winding is reduced, which is possible because of the thinner center leg. This in turn results in a reduction in the material, for example copper, which is used for the winding, thus ensuring that the inductive component can be produced and used in a manner which conserves resources. Therefore, not only the reduced costs for the magnetic core but also the reduced costs for the winding contribute to reducing the costs and to achieving advantages for the inductive component. On the other hand, the electrical characteristics of the inductive component are improved, because the shorter overall length of the wire in the winding reduces the losses in the winding, and increases the efficiency of the inductive component.

In the case of the inductive component, it is advantageous for the center leg to be formed with the aid of ferromagnetic powder material, and for the remaining parts of the core to be formed from ferrite material. The high saturation level of the center leg that is created in this way optimizes the saturation behavior of the core overall, and the magnetic flux through the center leg can be optimally distributed between the adjacent parts of the core composed of ferrite material. In order to transfer the flux optimally from the center leg to the adjacent core parts, the shape of the center leg is adapted, for example by means of a central part having a small diameter, which increases in size towards the transition to the adjacent ferrite material, in the foot area of the center leg. The diameter and the thickness of the transitional part depend on the limit values for the magnetic saturation of the two ferromagnetic materials.

A transitional part such as this between the center leg and the adjacent other core parts is preferably composed of the same material as the material in the central part of the center leg, that is to say, for example, of powder material. The transitional part has the advantage that it acts like a flange and is able to guide the winding at the side. The transitional part therefore carries out a flange function, which is similar to the function of a flange of a winding former. This flange-like transitional part may have the same external diameter as the winding. In the case of standard core shapes, such as a P or X core, there is therefore no need for a separate winding former. However, in the case of a center leg such as this with a flange function at the end, it is necessary for the center leg and the flange to be electrically isolated from the winding. For this purpose, the center leg and the flange are coated with a small thickness of insulating material, or the core windings themselves are insulated. This insulating coating material on the elements of the center leg has zero permeability, or at most a low permeability, and results in the insulation on the end faces of the center leg forming partial air gaps. By way of example, the coating on the center leg may have a thickness of 0.2 mm, which is a normal coating thickness. The coating forms an air gap between the center leg and the other core parts.

In one embodiment, in which the center leg is formed from disks of different material, it is possible to use magnetic material in the form of a disk, for example, with ferromagnetic powder, and to arrange other disks composed of material with zero or low permeability between the disks that are arranged and composed of this material. Such intermediate disks composed of material of zero or low permeability are furthermore suitable for compensating for the differences between the height of the central column and of the center leg, and the outer core areas. A further function of a material such as this distributed in the form of a disk and with zero or low permeability in the center leg is to create a distributed air gap. Furthermore, the overall permeability can be reduced, the overall length of the air gap can be reduced, and the magnetic flux can be optimized.

In the case in which the center leg consists of two parts which, each formed from one piece, contain a magnetic material, the finished core, which is formed from two core halves, comprises as an air gap twice the isolation separation between the two central parts of the center leg and the respective distance between the outer part of the center leg and the adjacent core parts. An arrangement such as this furthermore reduces the stray flux in comparison to an arrangement with only one air gap. However, a reduction in the stray flux also means a reduction in the losses. In one exemplary embodiment, in which the permeability is reduced, the center leg comprises two identical or symmetrical parts between which a disk composed of material of zero permeability or with low permeability is arranged. The disk can compensate for differences, for example with respect to fit, between the center leg and the outer areas. A further aspect is that the disk splits the overall air gap into three parts, specifically two between the center leg ends and the other core areas and one between the two center leg parts, thus reducing the stray flux.

The provision of a plurality of air gaps, of a center leg composed of a material with low permeability, for example of iron powder, or the combination of ferrite areas with iron powder areas as center legs, reduces the stray flux or the losses. The provision of a plurality of air gaps in the center leg reduces the stray flux, the complexity and costs for the cooling system, and enhances the performance of the component.

A configuration of the magnetic core in which the center leg contains one material, for example a ferromagnetic powder, and the outer core part contains a different material, for example ferrite material, makes it possible to optimize the overall permeability of the core. This is possible because ferromagnetic powder, for example iron powder, has a permeability between 10 and 50, while ferrite material has a permeability in the range from 1000 to 3000. The use of a different material for the core, for example in the center leg, therefore makes it possible to reduce the overall permeability of the magnetic core arrangement, in comparison to a pure ferrite core. At the same time, an arrangement such as this makes it possible to distribute the overall effective air gap, and thus to reduce the stray flux and the losses resulting from it.

An inductive component having a magnetic core as proposed also has the advantage that the temperature response of the overall core arrangement can be improved. By way of example, ferrite material has a temperature dependency with a plurality of loss maxima. The overall temperature dependency of the proposed core arrangement can be improved both by variation options during production, for example during pressing and sintering, of the ferrite material and by the combination with a different ferromagnetic material, for example powder material. The permeability may depend on the temperature. By way of example, ferrite materials may have two peaks which can be shifted by variation of the production process. The optimization can be directed both at the center leg and at the other core areas, in which case it is possible to distinguish between the objectives of optimization, for example saturation level, loss and permeability, for the various core areas. The optimization makes it possible to reduce the overall permeability, the size of the air gap and the stray flux. Such optimization is impossible in the case of cores which consist only of the same material.

The center leg may be formed in various embodiments and, for example, may contain disks of different material and/or of the same material, which differs from the external core part. Furthermore, the center leg may comprise parts integrally formed like flanges at the ends. The individual parts of the center leg, which are arranged centrally one behind the other along a common axis, may be adhesively bonded to one another. However, it is advantageous to provide a central hole for the individual parts of the center leg, such that these can be connected to a correspondingly aligned hole in the external core parts by means of a screw. A screw such as this is, in particular, composed of insulating material and makes it possible to further optimize the overall permeability of the magnetic circuit of the inductive component. For example, this is possible by adjusting the pressure exerted by the screw on the central hole, and thus on the various core elements of the center leg and of the outer core areas. A change in the pressure exerted by the screw results in a change in the remaining air gap. Particularly if the center leg also comprises disks of zero or low permeability, it is possible to choose this material such that it is mechanically flexible. In particular, plastic and silicone may be used as materials, as a result of which the pressure exerted by the screw effectively has a springing function. The pressure exerted by the screw on the core parts may be adjusted, for example, by means of a torque wrench.

In the case where the center column contains ferrite or ferrite disks, these can be produced such that minimum losses occur at higher temperatures than in the case of the ferrite material, which differs therefrom, of the outer core part. Therefore, the temperatures of the center leg may in this case be higher than the temperatures of the outer core part. This results in better cooling conditions for the core arrangement, since the center leg can be cooled only by thermal conduction, while the overall core arrangement can also be cooled by convection or fan cooling. On the other hand, such ferrite disks of the center leg may also be produced using a material with higher saturation Bs than the outer core parts. The matching of the ferrite materials of the core areas to their operating temperatures in order to reduce the losses can be achieved by adaptation of the pressure, the temperature and of the sintering profile during sintering of the areas. Such variation of the production process for different core areas is impossible in the case of an integral core. A further approach is to use material with low permeability, for example iron powder, for the production of the center leg, which reduces the diameter, in order to reduce the effective turn length, the volume of the material for the winding and, in the end, the losses. The combination of the different materials, the reduced dimensions and the shorter line length optimizes the losses with respect to the magnetic material and the turns in comparison to a component with an integral core, thus also increasing the efficiency and reducing the costs.

Optimization with respect to the saturation level can be achieved by the use of different magnetic materials for the different core parts. For example, the ferrite disks in the center leg composed of a material with a higher saturation level can be manufactured to match the operating temperature. The operating temperature of the center leg is higher than that of the outer core areas; by way of example, the former is in the region of 100 degrees Celsius, and the latter in the region of 80 degrees Celsius. In the case of ferrite material, the saturation level increases as the temperature falls. For example, when there is a temperature drop between center legs and the outer core area, the saturation level is increased by about 20 mT for normal ferrite material.

BRIEF DESCRIPTION OF THE DRAWINGS

Exemplary embodiments of the invention are illustrated in the figures of the drawing. The same functional elements are in this case represented by the same reference symbols.

DETAILED DESCRIPTION OF ILLUSTRATIVE EMBODIMENTS

Although the exemplary embodiments show cross sections of inductors, it is self-evident that transformers or reactors may also be designed in a corresponding manner, instead of inductors. Different core shapes can likewise be provided, for example, with a P or X shape or as pot-type or shell-type cores. In this case, an X-core means a core shape which comprises at least four yoke areas, which diverge radially from one another, adjacent to the center legs, at each of the ends of which yoke areas a limb is fitted, in the direction of the center leg. P and X-cores have a compact shape with little disturbance effect.

Figure 1:
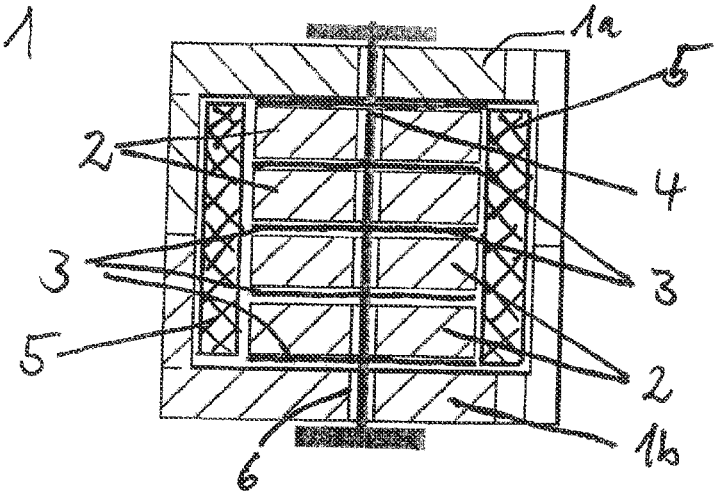
FIG. 1 shows an inductor with center legs in the form of disks and with a distributed air gap with a P-core.

According to the cross section in FIG. 1, a P-core is formed from two core parts 1*a* and 1*b* placed opposite one another, which may be composed of ferrite material. A leg, which is in the form of a disk composed of different materials, is arranged centrally within the core. The center leg therefore contains disks 2, which contain either ferromagnetic powder or a ferrite material which is different from the ferrite material of the outer core part 1*a*, 1*b*. A material 3 with zero or only a low permeability, is arranged between the disks 2. Alternatively, these disks are formed from the material 3, advantageously flexibly, or there is an insulation coating of the ferromagnetic disks 2.

The winding 5 is arranged between the center leg and the outer core parts. The overall arrangement of the inductive component is held together by a screw 4 in a hole 6 which passes through and connects the outer core parts and the center legs to one another. The air gap, which is distributed between the areas with zero or with low permeability between the ferromagnetic disks and outer core area, is adjusted by pressure which the compressive force of the screw exerts on the outer core part and the center leg.

Figure 2:
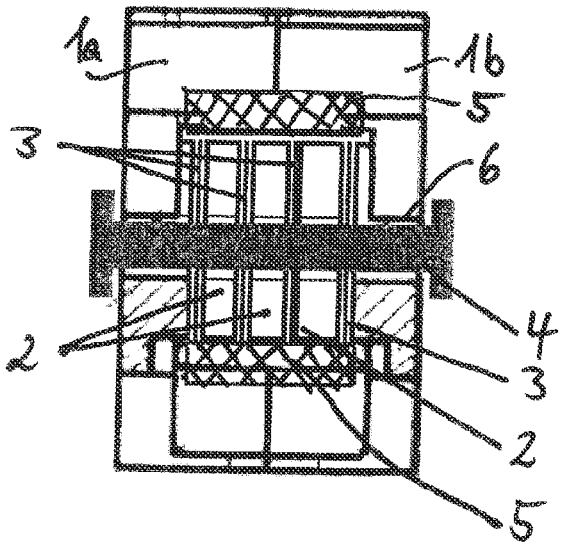
FIG. 2 shows an inductor with an X-core and center legs in the form of disks with a distributed air gap.

FIG. 2 shows an inductor arrangement in which an X-core is used. The arrangement shows two outer core halves 1*a* and 1*b*, which may be composed of ferrite material, as well as ferromagnetic disks 2 of the center leg, which are separated from one another by a material 3 with zero or with low permeability, or alternatively by an insulation coating. The winding 5 of the inductor is arranged between the layer structure of the center leg and the outer core parts 1*a* and 1*b*. All of the parts of the core are held together and guided by a screw 4 which passes through a hole 6. By way of screw 4, the compressive force on the elements of the magnet core can be adjusted. A spatially distributed air gap is also achieved in this exemplary embodiment.

Figure 3:
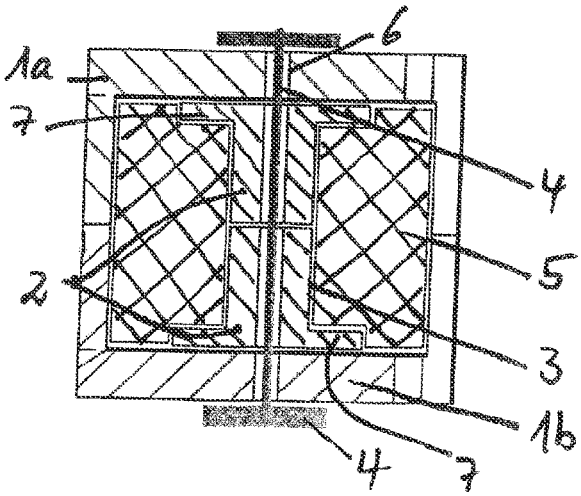
FIG. 3 shows an inductor with a center column and a flange arranged at the end.

FIG. 3 shows an inductor having a P or an X-core, in which the external halves 1*a* and 1*b* contain ferrite. The central leg contains two parts 2 which contain a flange 7 at the end facing the external core areas. The center leg may be composed of iron powder. The flange 7 results on the one hand in the magnetic flux being distributed better from the center leg to the outer core parts, and on the other hand in the winding 5 being at least partially guided.

The isolation between the winding 5 and the core 1*a* and 1*b* is, in particular, in the form of an insulated winding or an insulating coating on the center leg. In the latter case, it is possible to fit the winding directly in the intermediate area between the center legs and the external core parts. The insulation coating on the center leg in this case at the same time carries out the function of distributing the air gap of the inductor over the central area between the center leg halves and the two outer flange areas. This results in improved loss conditions for the inductor, thus meaning that, overall, the inductor has a smaller physical form and at the same time improved characteristics in comparison to conventional inductors. In one exemplary embodiment, a disk composed of flexible material (not shown in FIG. 3) can be provided between the parts 2 of the center leg. The permeability of the disk is low or zero. Because the disk is flexible, it acts as a spring. Using the flexibility of the disk, the screw makes it possible to vary the distance between the parts 2 of the center leg.

Figure 4:
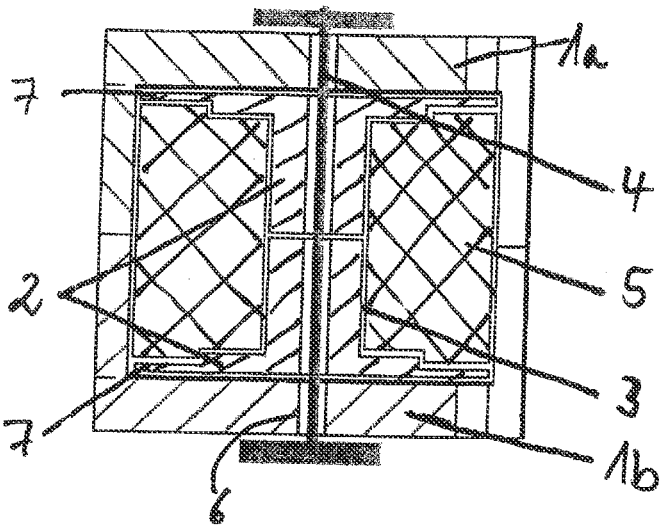
FIG. 4 shows an inductor with a center column with a flange at the end, and the function of a winding former.

FIG. 4 shows an arrangement with a P or X-core shape, which differs from FIG. 3 in that the areas 7 which are in the form of flanges and are arranged at the end between the center leg parts 2 and the external core parts 1*a* and 1*b*, extend from the central hole 6 with the guide screw 4 toward the external core parts. This makes it possible to arrange the winding 5 completely in the area formed by the flanges, thus also making it possible to dispense with a separate winding former for the winding. The increase in the diameter of the center leg 2 in steps acts as a transitional area for distribution of the flux and for holding the winding 5. Together, the center part of the center leg 2 and the steps therefore govern the shape of the winding 5.

Figure 5:
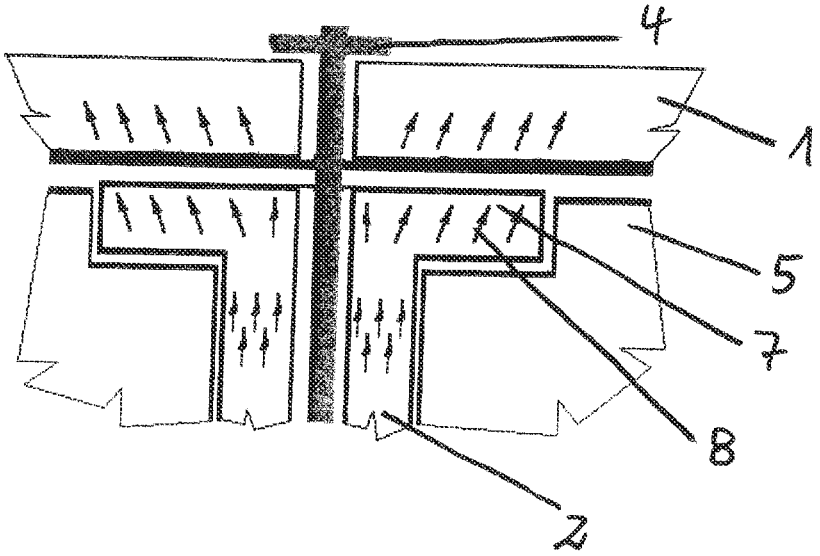
FIG. 5 shows a detail of the profile of the magnetic flux density in the transitional area from the center leg with an end flange to external core areas.

FIG. 5 schematically illustrates the transition of the magnetic flux from the center leg 2 over the flange, which is arranged on this center leg 2 at the end, toward the external core parts. As is illustrated purely schematically on the basis of the arrows 8, the very high magnetic flux in the center leg 2 has already been reduced and distributed in the transitional area of the flange 7, thus ensuring matching to the flux which is present in the outer ferrite part 1 of the core. In one exemplary embodiment, the center leg 2 is composed of iron powder. The other parts of the core are composed of ferrite material. The transitional area optimizes the flux transition between the parts, in which it is necessary to distribute the flux from the center leg 2 with a higher saturation level on the basis of the iron powder, to the ferrite material with a lower saturation level. The thickness and the diameter of the transitional area depend on the ratio of the saturation levels in the center leg 2 and the other core parts.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

The invention claimed is:

1. An inductive component comprising:

a core comprising a center leg and separate outer core parts arranged opposite to one another, the center leg being located between at least two of the separate outer core parts such that the at least two outer core parts are adjacent to face sides of the center leg, the center leg comprising separate areas that contain different magnetic materials; and a winding located between the center leg and the outer core parts;

wherein each of the different magnetic materials is different from a material of the separate outer core parts.

2. The inductive component according to claim 1, wherein the different magnetic materials have different magnetic characteristics.

3. The inductive component according to claim 1, wherein the different magnetic materials comprise a material type with different magnetic parameters.

4. The inductive component according to claim 1, wherein the inductive component has total magnetic core characteristics that are different than magnetic core characteristics associated with each individual one of the different magnetic materials.

5. The inductive component according to claim 1, wherein the core comprises a layer sequence of different materials is adhesively bonded or screwed to one another.

6. The inductive component according to claim 1, wherein the different magnetic materials comprise a sequence of layers.

7. The inductive component according to claim 1, wherein the center material of the separate outer core parts is a magnetic material that differs from each of the different magnetic materials of the center leg separate areas.

8. The inductive component according to claim 7, wherein the center leg contains a ferromagnetic powder, and the outer core parts contain ferrite.

9. The inductive component according to claim 7, wherein the center leg contains a plurality of layers composed of magnetic material.

10. The inductive component according to claim 9, wherein the layers of the center leg are provided with an insulating coating.

11. The inductive component according to claim 1, further comprising a flexible material of low or zero permeability arranged between areas of material with higher permeability.

12. The inductive component according to claim 1, wherein the center leg has two parts.

13. The inductive component according to claim 12, wherein the center leg has two parts composed of material with higher permeability, between which a disk composed of flexible material with low or zero permeability is arranged.

14. The inductive component according to claim 1, wherein the center leg has a formed-out area in the form of a flange at an end facing the outer core parts.

15. The inductive component according to claim 9, wherein the plurality of layers comprise a plurality of disk-shaped layers.

* * * * *